US006024628A

United States Patent [19]

Chen

[11] Patent Number: 6,024,628

[45] Date of Patent: Feb. 15, 2000

[54] METHOD OF DETERMINING REAL TIME REMOVAL RATE FOR POLISHING

[75] Inventor: Hsueh-Chung Chen, Taipei Hsien, Taiwan

[73] Assignee: United Microelectronics Corp., Taiwan

[21] Appl. No.: 09/235,690

[22] Filed: Jan. 22, 1999

[51] Int. Cl.[7] ..... B24B 49/00; B24B 51/00

[52] U.S. Cl. ..... 451/5; 451/6; 451/28; 451/41

[58] Field of Search ..... 451/5, 6, 28, 41, 451/63, 285, 287, 288, 289; 352/382; 438/690, 691, 692, 693; 216/88, 89, 24, 26

[56] References Cited

U.S. PATENT DOCUMENTS 5,433,651 7/1995 Lustig et al. ..... 451/6
5,643,050 7/1997 Chen ..... 451/6
5,663,797 9/1997 Sandhu ..... 451/6
5,791,969 8/1998 Lund ..... 451/6
5,872,633 2/1999 Holzapfel et al. ..... 356/381

*Primary Examiner*—Derris Holt Banks
*Attorney, Agent, or Firm*—Blakely Sokoloff Taylor & Zafman

[57] ABSTRACT

A method of determining a real time removal rate. A material layer is polished. During the polishing process, a light is incident onto the material layer continuously. The incident light is reflected from the material layer with a reflected light intensity. By integrating the reflected light intensity, followed by dividing the integration with a product of a differential of the reflected light intensity and the polishing time, an I-Dt transformation is obtained. The I-Dt transformation has a period which reflects the removal rate through calculation of optical principle.

8 Claims, 3 Drawing Sheets

METHOD OF DETERMINING REAL TIME REMOVAL RATE FOR POLISHING

BACKGROUND OF THE INVENTION

1. Field of the Invention

The invention relates in general to a method of determining a removal rate of a material layer, and more particularly, to a method of determining the real time removal rate of chemical-mechanical polishing.

2. Description of the Related Art

Chemical mechanical polishing (CMP) is currently the only technique that can achieve a global planarization in very large scaled integration (VLSI), or even ultra large scaled integration (ULSI). The technique of chemical mechanical polishing has been widely applied to semiconductor fabrication process. However, it is still a problem of how to determine a removal rate during the process, which is a crucial factor to determine the stability and reaction mechanism of the CMP process.

SUMMARY OF THE INVENTION

A method of determining a real time removal rate is provided. While a material layer is provided and polished, a light is continuously incident onto the material layer. A reflected light is collected during polishing. An intensity of the reflected light is recorded. The intensity of the reflected light is then integrated by a polishing time, followed by being divided by a product of a differential of the intensity of the reflected light and the polishing time. Thus, an I-DT transformation curve is obtained, wherein I represents the integration of the intensity of the reflected light, D stands for the differential of the reflected light intensity, and t represents the polishing time. The period of the polishing step can thus be obtained from the I-DT transformation curve.

The invention thus provides a method for real time determination of removal rate. That is, during the chemical mechanical process, a real time removal rate can be obtained.

The invention further provides a method of controlling the polishing quality in a real time manner. The CMP process can thus be performed stably.

Both the foregoing general description and the following detailed description are exemplary and explanatory only and are not restrictive of the invention, as claimed.

DESCRIPTION OF THE PREFERRED EMBODIMENTS

Figure 1:
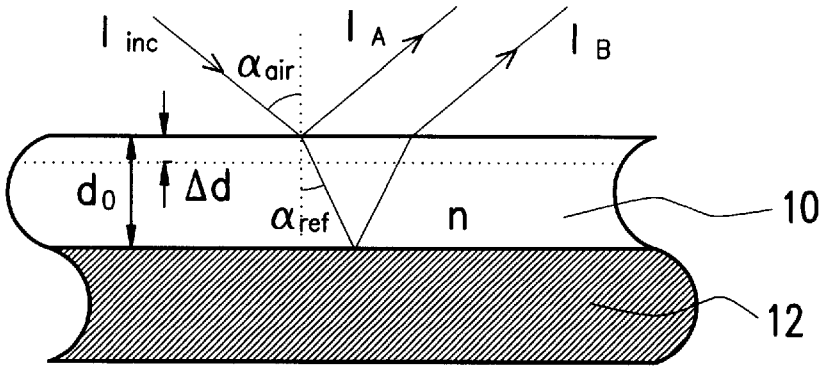
FIG. 1 schematically shows a theory to determine a polishing endpoint of a chemical mechanical polishing process.

In FIG. 1, a material layer 10 is formed on a provided substrate 12. Using chemical mechanical polishing, the material layer 10 is polished. Assuming the material layer has an initial thickness of $d_0$. During the CMP process, the removed thickness is denoted as $\Delta d$. An incident light $I_{inc}$, preferably a laser light, shines onto the material layer 10 continuously during the polish process. An incident angle is denoted as $\alpha_{air}$. The material layer 10 may be an oxide layer, nitride layer, or other dielectric layer of which the optical properties such as the refractive index and the wavelength are measurable. Being reflected by the top surface and bottom surface of the material layer 10, a first and a second reflected lights with intensity of $I_A$ and $I_B$ are collected. The total intensity of the first and the second reflected lights are denoted as I. The relationship between I, $I_A$, and $I_B$ can be obtained from principles of optical interference:

$$I = I_A + I_B + 2\sqrt{I_A \cdot I_B}\cos(\phi) \tag{1}$$

wherein, $$\phi = \frac{4\pi n(d_0 - rt)}{\lambda_0 \cos(\alpha_{ref})},$$

and t is the polishing time, n is the refractive index of the material layer 10, r is the removal rate, $\lambda_0$ is the wavelength of the incident light, $\alpha_{ref}$ is the reflected angle.

Figure 2:
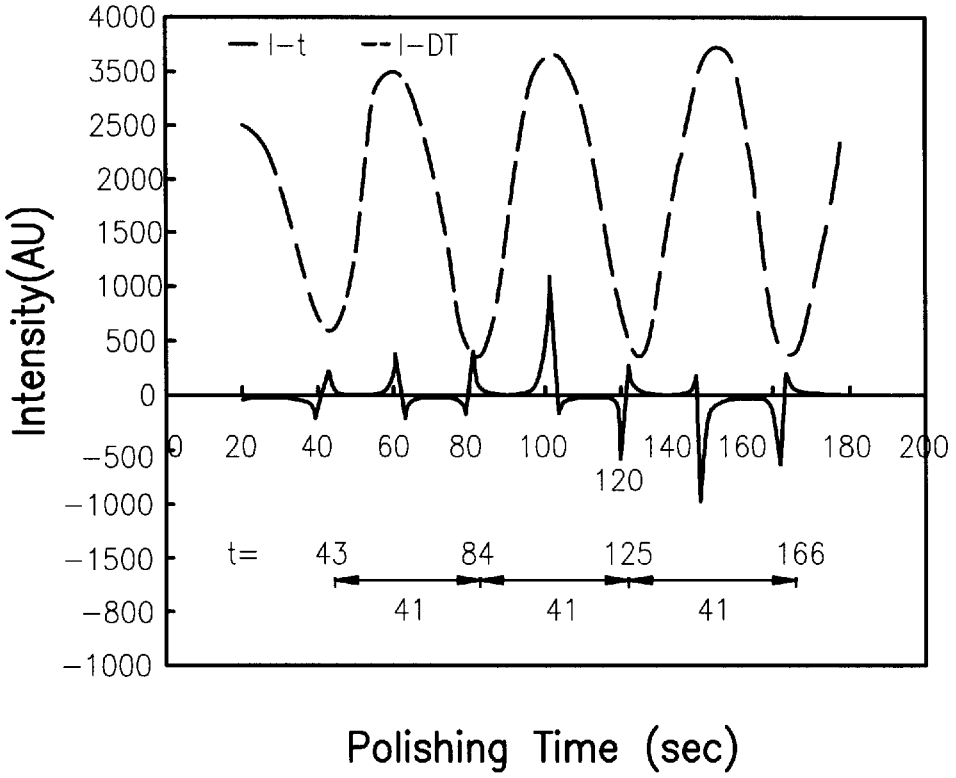
FIG. 2 shows an I-DT transformation curve for polishing an oxide layer.

An intensity versus polishing curve I-t is shown in FIG. 2. From Eq. (1) and FIG. 2, it is known that the reflected light intensity I comprises a cosine factor, and thus, a period is observed in the curve. The period of the curved can be represented as:

$$T = \frac{\lambda_0 \cos\alpha_{ref}}{2nr}. \tag{2}$$

In FIG. 2, another I-Dt curve is also plotted. The reflected light intensity I is integrated with the polishing time t, followed by being divided by a product of a differential of the reflected light intensity I and the polishing time t. The I-Dt transformation can be derived from:

$$\frac{\int I dt}{I' \cdot t} = -\frac{(I_A + I_B)}{2\sqrt{I_A \cdot I_B}}\csc(\phi)\frac{dt}{d\phi} - \frac{1}{t}\left(\frac{dt}{d\phi}\right)^2 \tag{3}$$

Again, it is shown that the I-Dt curve comprises a cosecant term, therefore, a period can be obtained from the figure. Substituting the period T, the measurable initial thickness $d_0$ and refractive index n of the material layer, the wavelength of the incident light $\lambda_0$, and the period T obtained from the figure into Eq. (2), the removal rate r can be calculated. For example, considering a blanket plasma enhanced chemical vapor deposition (PECVD)-oxide layer having a thickness of about 12.5 KÅ is formed on a silicon substrate. A light with a wavelength $\lambda_0$=6700 Å is incident onto the PECVD-oxide layer with a reflected angle $\alpha_{ref}$=10°. The refractive index n of the oxide layer is about 1.458. From FIG. 2, the period of the I-Dt curve is 41 sec. Substituting these parameters into Eq. 2, the removal rate can be derived:

$$r = \frac{\lambda_0 \cos(\alpha_{ref})}{2nT}$$

-continued $$r = 6700(\text{Å}) \times \cos(10^\circ) / [2 \times 1.458 \times 41(\text{sec})]$$
$$= 55.2\ \text{Å/sec} = 3312\ \text{Å/min.}$$

By empirical measurement, a removal rate of about 3572 Å is obtained. The error of the calculated value is about 7%. The reason causing the error mainly depends on the positions of the measuring points. As shown in the figure, since the material layer has a uniform surface, and the I-Dt curve has a constant period of 41 sec. It is predicted that the polishing process of the blanket material layer is maintained with a stable removal rate.

Moreover, the reason why the I-Dt transformation is calculated and the curve thereof is plotted is that the I-Dt transformation has a cosecant term. With to the cosecant term, the I-Dt transformation curve has a very sharp peak during a certain period of time. The period T can thus be easily obtained without observing the I-t curve through several observing windows.

Figure 3:
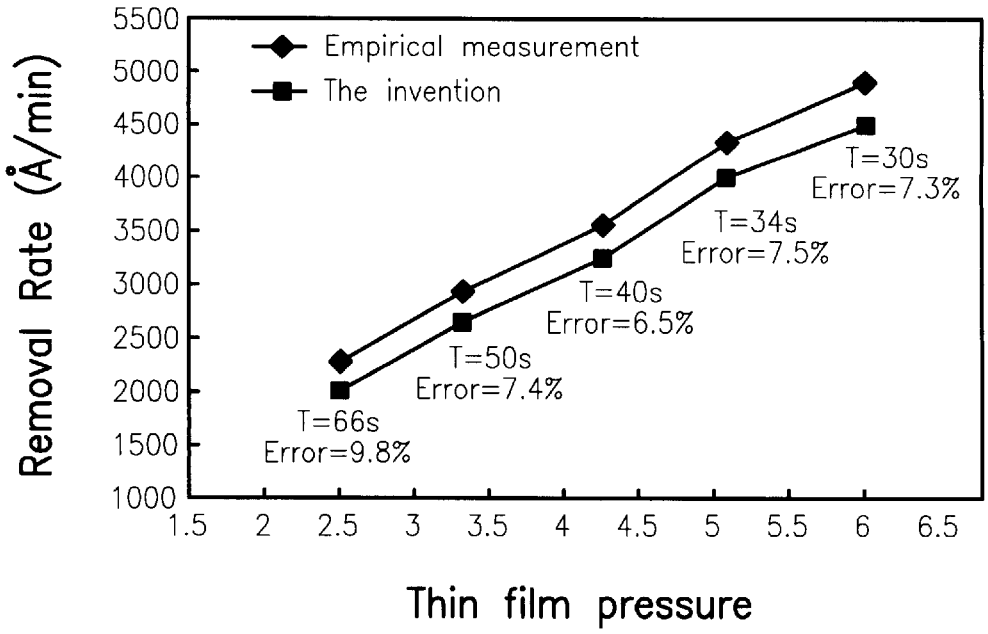
FIG. 3 shows a comparison of removal rates obtained by empirical measurement and method of the invention for polishing a blanket oxide layer under different polishing pressure.

FIG. 3 shows the variation of the removal rate under different polishing pressure. During CMP process, the chemical mechanical polisher applies a polishing pressure to the material layer to be polished. The polishing pressure directly affects the removal rate. In the figure, the polishing pressure varies in a range from 2.4 psi (pound per square inch) to 6.0 psi. Data with an error ranged within 10% is acceptable. In addition, the error can be corrected by empirical measurement.

Figure 4:
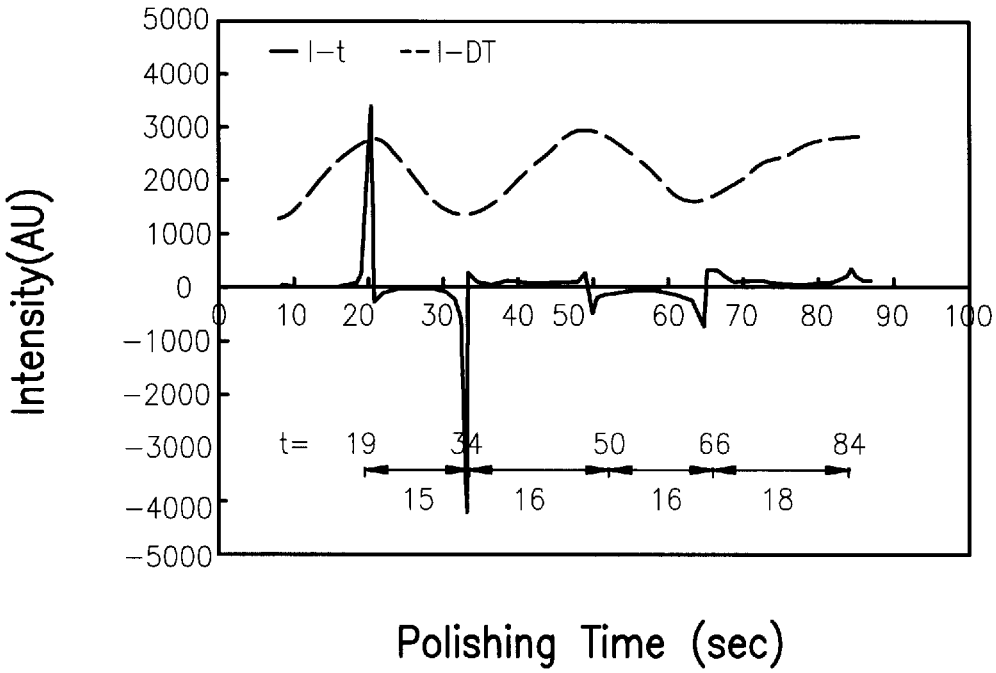
FIG. 4 shows the curve of the reflected light intensity and the I-DT transformation curve.

In FIG. 4, an I-t curve and an I-Dt transformation curve for polishing a patterned material layer is shown. As shown in the figure, since the pattern density is varied during the polishing, the period T is not a constant between every two adjacent peaks. The variation of the period T reflects the variation of the surface pattern density. Therefore, the removal rate for each polishing period T can be calculated by substituting the different values of T into Eq. (2).

Figure 5:
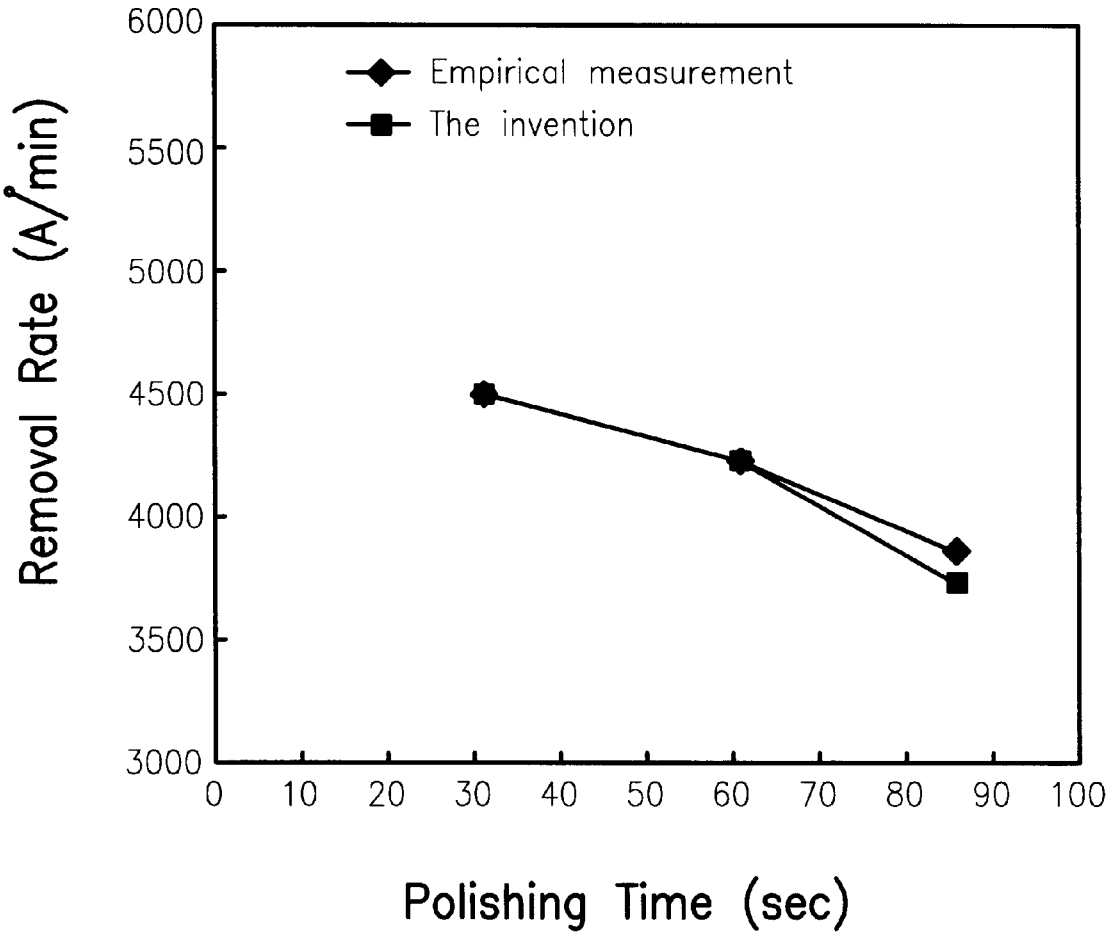
FIG. 5 shows a comparison of removal rates obtained by empirical measurement and method of the invention for polishing a patterned oxide layer under different polishing pressure.

FIG. 5 shows a comparison of removal rates obtained from both empirical measurement and theoretical evaluation. Again, the results show that the theoretical evaluation determine a removal rate precisely.

Thus, the invention comprises at least the following advantages.

1. A period of the I-Dt transformation curve comprises a cosecant term. Therefore, the period of the curve can be obtained instantly without going through several observing windows.

2. By substituting the period of the I-Dt transformation curve into Eq. (2), a real time removal rate can be determined.

3. The real time removal rate for polishing a blanket material layer can be obtained. In addition, the real time removal rate for material layer with variable pattern density can also be calculated.

4. The invention may be used to monitor and control the polishing quality of a material layer. Moreover, the invention may also be applied to any polishing process apart from chemical mechanical polishing.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A method of determining a real time removal rate for polishing, comprising:

polishing a material layer;

continuously shining an incident light onto the material layer during the polishing step;

measuring a reflected light intensity I of the incident light, integrating the reflected light intensity I by a polishing time t, and obtaining an I-Dt transformation curve by dividing the integration of the reflected light intensity I with a product of a differential of the reflected light intensity I and the polishing time t;

obtaining a period of the I-Dt transformation curve; and calculating the removal rate according to optical principle of reflection.

2. The method according to claim 1, wherein the polishing step comprises a chemical mechanical polishing step.

3. The method according to claim 1, wherein the incident light comprises a laser light.

4. The method according to claim 1, wherein the material layer comprises a blanket material layer.

5. The method according to claim 1, wherein the material layer comprises a patterned material layer.

6. The method according to claim 1, wherein the reflected light intensity can be derived from:

$$I = I_A + I_B + 2\sqrt{I_A \cdot I_B}\cos(\phi)$$

wherein:

$I_A$ represents a first reflected light which is reflected by a top surface of the material layer;

$I_B$ represents a second reflected light which reflected by a bottom surface of the material layer; and $$\phi = \frac{4\pi n(d_0 - rt)}{\lambda_0 \cos(\alpha_{ref})}$$

n is a refractive index of the material layer;

$d_0$ is an initial thickness of the material layer before performing the polishing step;

r: is the removal rate;

$\lambda_0$ is a wavelength of the incident light; and $\alpha_{ref}$ is a reflected angle of the reflected light.

7. The method according to claim 1, wherein the I-Dt transformation can be represented by:

$$\frac{\int I dt}{I' \cdot t} = -\frac{(I_A + I_B)}{2\sqrt{I_A \cdot I_B}}\csc(\phi)\frac{dt}{d\phi} - \frac{1}{t}\left(\frac{dt}{d\phi}\right)^2$$

wherein:

$I_A$ represents a first reflected light which is reflected by a top surface of the material layer;

$I_B$ represents a second reflected light which reflected by a bottom surface of the material layer; and $$\phi = \frac{4\pi n(d_0 - rt)}{\lambda_0 \cos(\alpha_{ref})}$$

n is a refractive index of the material layer;

$d_0$ is an initial thickness of the material layer before performing the polishing step;

r: is the removal rate;

$\lambda_0$ is a wavelength of the incident light; and $\alpha_{ref}$ is a reflected angle of the reflected light.

8. The method according to claim 1, wherein the period T has the following relationship:

$$T = \frac{\lambda_0 \cos(\alpha_{ref})}{2nr}$$

wherein, $\lambda_0$ is a wavelength of the incident light;

$\alpha_{ref}$ is a reflected angle of the reflected light;

n is a refractive index of the material layer; and r is the removal rate.

* * * * *